US005249448A

United States Patent [19]

Fedor et al.

[11] Patent Number: 5,249,448

[45] Date of Patent: Oct. 5, 1993

[54] REDRAW CARRIAGE FOR CRANK AND SLIDE PRESS

[75] Inventors: Russell J. Fedor, Tampa; Marc D. Sullivan, Brooksville, both of Fla.

[73] Assignee: Ball Corporation, Muncie, Ind.

[21] Appl. No.: 910,928

[22] Filed: Jul. 9, 1992

[51] Int. Cl.[5] ..... B21D 24/04

[52] U.S. Cl. ..... 72/349; 72/456

[58] Field of Search ..... 72/347, 349, 350, 456

[56] References Cited

U.S. PATENT DOCUMENTS

| | | | |
|---|---|---|---|
| 3,402,591 | 9/1968 | Maeder | 72/349 |
| 3,696,657 | 10/1972 | Maytag . | |
| 3,704,619 | 12/1972 | Paramonoff | 72/349 |
| 4,702,098 | 10/1987 | Pora et al. . | |
| 4,807,459 | 2/1989 | Grims et al. . | |
| 4,934,167 | 6/1990 | Grims et al. . | |
| 4,976,131 | 12/1990 | Grims et al. . | |
| 5,129,252 | 7/1992 | Hahn et al. | 72/349 |

*Primary Examiner*—Lowell A. Larson

*Attorney, Agent, or Firm*—Gilbert E. Alberding

[57] ABSTRACT

Redraw carriage apparatus (28) for use with a crank and slide press (10) includes a redraw carriage (32) that is secured to frame members (14*a* and 14*b*) by spaced-apart guide rods (34), and by spaced-apart support frames (36 and 37) that are bolted to respective ones of the frame members (14*a* and 14*b*) by cap screws (30), that are homed against one of the frame members (14*b*) by homing cap screws (76), and that support first and second (60 and 62) ends of the guide rods (34). Removal and replacement of the redraw carriage apparatus (28) is achieved by removal of the cap screws (30 and 76) and by movement of the redraw carriage apparatus (28), without disturbing alignment of a tool pack subassembly (16), by movement that is transverse to a longitudinal axis (24).

7 Claims, 3 Drawing Sheets

REDRAW CARRIAGE FOR CRANK AND SLIDE PRESS

BACKGROUND OF THE INVENTION

1. Field of the Invention

The present invention relates generally to crank and slide presses for manufacturing metal containers. More particularly, the present invention relates to a redraw carriage apparatus that may be easily and rapidly removed, replaced, and aligned.

2. Description of the Related Art

Crank and slide presses are used for punching, shearing, drawing, and redrawing operations in manufacturing articles from metallic sheets or rolls of metallic strip material. In general, a crank and slide press includes a crank that is mounted for rotary motion, an electric motor that is connected to the crank that imparts rotary motion thereto, a connecting rod that is attached to the crank, and mechanism for changing motion from the connecting rod to rectilinear reciprocating motion. A more detailed description of crank and slide presses is given by Maytag in U.S. Pat. No. 3,696,657, issued Oct. 10, 1972.

One specific use for a crank and slide press is in the production of beverage cans. A redraw cup is drawn from a coiled strip by a first crank and slide press, and then the redraw cup is redrawn on a second crank and slide press forcing the redraw cup through a tool pack subassembly that includes a redraw die and plurality of ironing dies.

In the highly competitive container industry, a container must be made with the absolute minimum of material, which means that the finished container must have extremely thin walls. It should be apparent that the use of extremely thin walls of the finished containers places stringent concentricity requirements upon the walls of the container and upon such parts of the tooling as the redraw punch and redraw die.

Further, because of the competitiveness of the container industry, the speed of the press must be maximized and downtime of the press must be minimized. As should be apparent, maximizing speed and minimizing down time are inherently opposite, because higher speeds impose higher stresses on the machinery and cause higher wear rates.

In the redraw operation, a tool pack subassembly, with the redraw die thereof, is mounted circumferentially around the longitudinal axis wherein the body maker ram is reciprocated; a redraw punch is attached to the body maker ram and is reciprocated towards, into, and through the tool pack subassembly including both the redraw die and the ironing dies thereof; and the redraw punch is withdrawn from the tool pack subassembly and all of the parts thereof.

A redraw cup is positioned against the redraw die and is resiliently held against the redraw die by a redraw sleeve, the redraw sleeve is attached to a redraw carriage, and the redraw carriage is reciprocated toward and away from the redraw die.

The redraw sleeve serves two functions. One function of the redraw sleeve is to assure concentricity between the redraw cup and the redraw die. The other function of the redraw sleeve is to provide resilient clamping between a clamping face of the redraw sleeve, the redraw cup, and the redraw die, thereby preventing wrinkling of the metal as the redraw cup is redrawn through the redraw die.

In the prior art, such as typified by the aforesaid patent to Maytag, the redraw carriage has been actuated toward the redraw die by a cam that is attached to the crank of the press, and by a cam follower mechanism that receives motion from the cam and then transfers this motion to the carriage. It has been customary to use an air cylinder to maintain the cam follower in contact with the cam and to actuate the redraw carriage away from the redraw die.

Various methods have been used to attach the redraw carriage to the crank and slide press. One of these methods has been to mount the redraw carriage on guide rails and to use rollers both on top of and underneath the guide rails to position and align the redraw carriage, as shown in the aforementioned patent to Maytag. However, this method of mounting has required high maintenance to maintain alignment, and considerable time has been required to remove, replace, and realign the redraw carriage.

Grims et al., U.S. Pat. No. 4,807,459, which was issued on Feb. 28, 1989, shows a device in which the redraw carriage is slidably mounted to a pair of spaced-apart guide rods, and these guide rods are secured to the tool pack subassembly. The primary weakness of this design is that removal of the tool pack subassembly automatically means removal of, or at least removal of alignment of, the redraw carriage as the tool pack subassembly is removed and the guide rods are pulled away from, and out of, the redraw carriage.

In contrast to the prior art, the present invention provides a redraw carriage subassembly which can be rapidly removed, replaced, and realigned without disturbing the tool pack subassembly. Removal consists of removing four cap screws and moving the carriage subassembly transversely away from the longitudinal axis of the machine. Replacement consists of moving a new or rebuilt subassembly transversely to the longitudinal axis of the body maker ram, loosely securing the redraw carriage subassembly to the frame of the machine with four cap screws, homing the redraw carriage subassembly against one frame member by the use of two homing screws, and tightening the four cap screws.

In a first aspect of the present invention, redraw carriage apparatus is provided for use in a can-making machine that includes a frame having a pair of spaced-apart frame members, a redraw die being disposed around a longitudinal axis in a plane intermediate of the frame members, a body maker ram having both a first end proximal to the redraw die and a second end that is attached to a ram carriage distal from the redraw die, a redraw punch being attached to the body maker ram proximal to the first end thereof and being reciprocable along the longitudinal axis with the redraw punch entering into and withdrawing from the redraw die, which redraw carriage apparatus comprises a first guide rod being disposed intermediate of the redraw die and the ram carriage, being disposed parallel to the longitudinal axis, and being attached to one of the frame members; a second guide rod being disposed parallel to the first guide rod and being attached to the frame; a redraw carriage being disposed around the longitudinal axis, and being slidably mounted to the guide rod; means, including means for forcing the one guide rod transversely with respect to the one frame member, for aligning one of the guide rods with respect to the one frame member; and means, including the redraw carriage being slidably mounted to the guide rods, for aligning the other of the guide rods with respect to the one frame member.

In a second aspect of the present invention, redraw carriage apparatus is provided for use in a can-making machine that includes a frame having a pair of spaced-apart frame members, a redraw die being disposed around a longitudinal axis in a plane intermediate of the frame members, a body maker ram having both a first end proximal to the redraw die and a second end that is attached to a ram carriage distal from the redraw die, a redraw punch being attached to the body maker ram proximal to the first end thereof and being reciprocable along the longitudinal axis with the redraw punch entering into and withdrawing from the redraw die, which redraw carriage apparatus comprises first and second guide rods each having first and second ends, both being disposed parallel to the longitudinal axis, and being spaced apart; a redraw carriage being disposed around the longitudinal axis, and being slidably mounted to the guide rods; a first support frame being attached to the one frame member, and having first and second spaced-apart support posts each with a bore that supportingly receives one of the ends of the first guide rod; a second support frame being attached to the other of the frame members, and having first and second spaced-apart support posts each with a bore that supportingly receives one of the ends of the second guide rod; means, including means for loosening the attachment of the support frames from the frame members, for removing the redraw carriage without removing the redraw carriage from the guide rods and without removing the redraw die; means, including a pair of homing screws, for aligning the first support frame with respect to the one frame member; and means, including the redraw carriage being slidably mounted to the guide rods, for aligning the second support frames with respect to the one frame member.

In a third aspect of the present invention, a method is provided for using a metal working crank and slide press that includes a frame having a pair of spaced-apart frame members, a tool pack subassembly including a redraw die that is disposed around a longitudinal axis in a plane intermediate of the frame members, a body maker ram having a first end proximal to the redraw die and a second end that is attached to a ram carriage distal from the redraw die and being reciprocable along the longitudinal axis, a redraw punch being attached to the body maker ram proximal to the first end thereof and both entering into and withdrawing from the redraw die, and a redraw carriage subassembly, including a redraw carriage, that is disposed intermediate of the tool pack subassembly and the ram carriage, which method comprises slidably inserting first and second guide rods into the redraw carriage to form the redraw carriage subassembly; attaching the first guide rod to one of the frame members; attaching the second guide rod to the frame; homing the first guide rod with respect to the one frame member; and using the redraw carriage to align the second guide rod with respect to the one guide rod.

SUMMARY OF THE INVENTION

In the present invention, a redraw carriage apparatus is provided for a metal working crank and slide press that includes a frame having a pair of spaced-apart frame members; a tool pack subassembly having a redraw die disposed therein, being disposed around a longitudinal axis, being disposed in a plane intermediate of the frame members, and being attached to the frame members; a body maker ram having a first end proximal to the redraw die and a second end distal therefrom, and being reciprocable along the longitudinal axis; a redraw punch being attached to the body maker ram proximal to the first end thereof, and both entering into and withdrawing from the redraw die; and a redraw carriage subassembly including a redraw carriage, and being disposed generally intermediate of the tool pack subassembly and the body maker ram.

The redraw carriage subassembly includes a pair of support frames that are attached to respective ones of the frame members with four cap screws, a pair of spaced-apart guide rods that are disposed parallel to the longitudinal axis and that are attached to respective ones of the support frames, and the redraw carriage being slidably mounted to the guide rods.

Removal and replacement of the redraw carriage subassembly is achieved by removing four cap screws, removing two homing cap screws, moving the redraw carriage subassembly transversely away from the longitudinal axis, moving a new redraw carriage subassembly transversely to the longitudinal axis, loosely inserting two cap screws in each of the support frames, inserting the two homing cap screws, homing one of the support frames against a shoulder of the proximal one of the frame members by tightening the two homing cap screws, and tightening the four cap screws.

Therefore, since the present invention provides means for permitting removal and replacement of the redraw carriage subassembly without affecting alignment of the tool pack subassembly, either of the subassemblies may be removed without affecting the alignment of the other subassembly.

DESCRIPTION OF THE PREFERRED EMBODIMENTS

Figure 1:
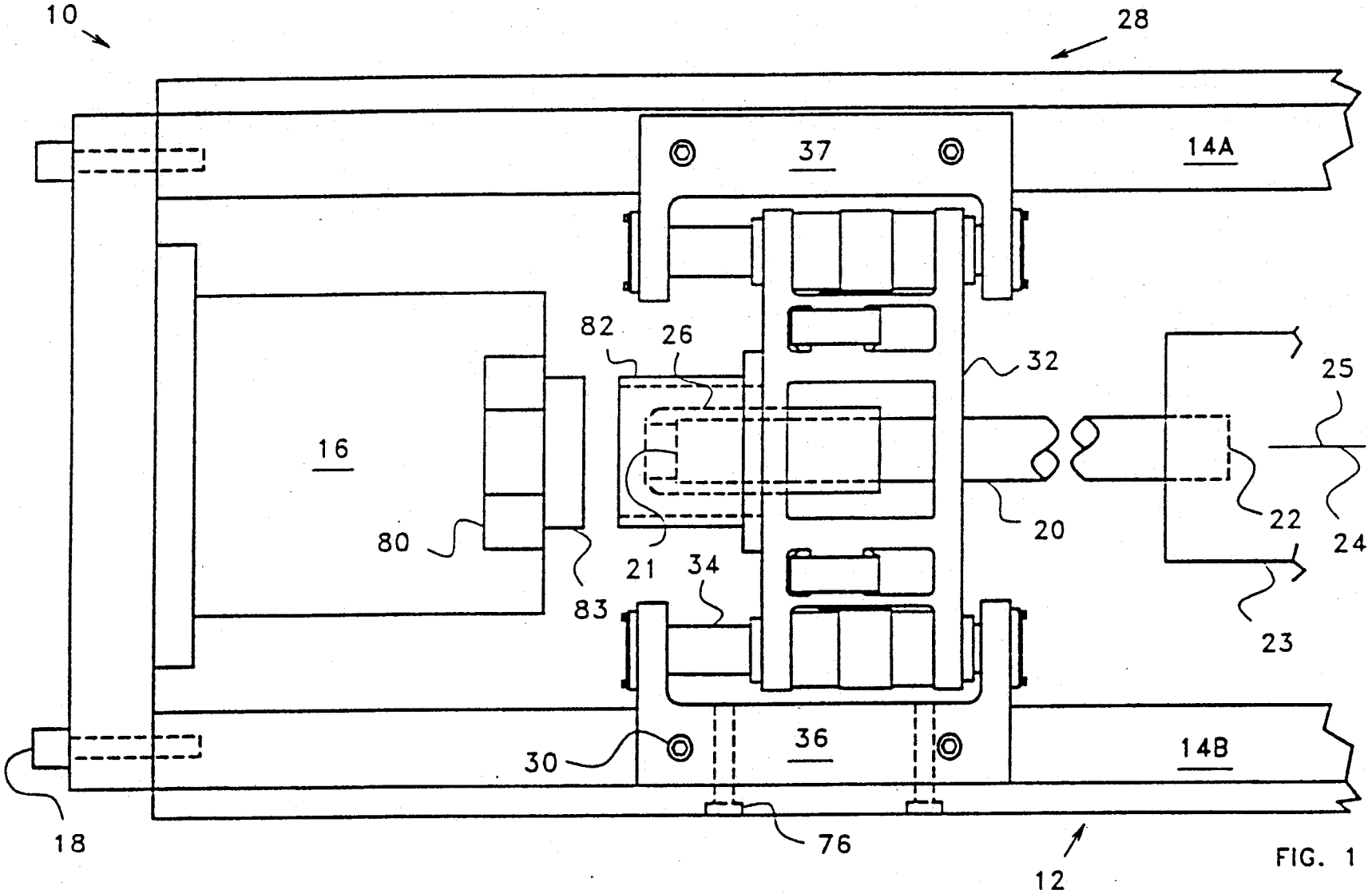
FIG. 1 is a partial top view of a metal working crank and slide press equipped with the tool pack subassembly of the present invention.

Referring now to FIG. 1, a metal working crank and slide press, or can-making machine, 10 includes a frame 12 having spaced-apart frame members **14*a* and 14*b*; a first subassembly, or tool pack subassembly, 16 being attached to the frame members, 14*a* and 14*b*, by cap screws 18; a body maker ram 20 having a first end 21 that is proximal to the tool pack subassembly 16 and a second end 22 that is attached to a ram carriage 23 distal from said tool pack subassembly 16, and being reciprocable along a longitudinal axis 24 that is located in a plane 25 intermediate of said frame members, 14*a* and 14*b*; a redraw punch 26 being attached to said body maker ram 20 proximal to said first end 21 thereof, and being reciprocable through and back out of said tool pack subassembly 16 by said body maker ram 20; and a second subassembly, or redraw carriage apparatus, or redraw carriage subassembly, 28 being attached to respective ones of the frame members, 14***a* and 14*b*, by cap screws 30.

The redraw carriage subassembly 28 includes a redraw carriage 32, a pair of spaced-apart guide rods, or support rods, 34, and a pair of spaced-apart support frames 36 and 37. Since the redraw carriage subassembly 28 is symmetrical about the longitudinal axis 24, and since only one half of a redraw carriage subassembly 28 is shown in FIG. 2, it will be understood that the detailed description refers in like manner to the portion shown in FIG. 1 but omitted in FIG. 2.

Figure 2:
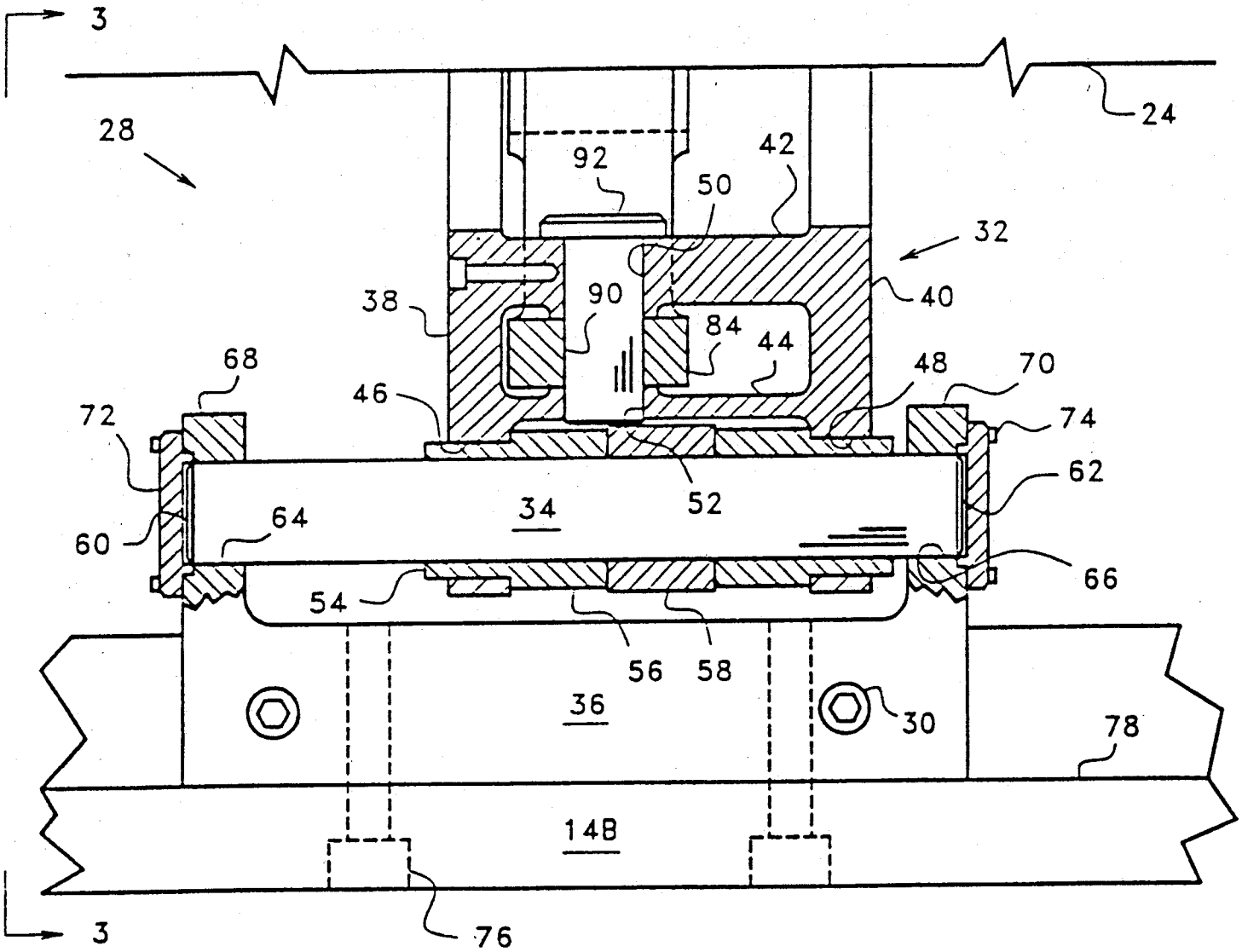
FIG. 2 is a partial and enlarged cross sectional view of the tool pack subassembly of FIG. 1, taken substantially as shown in FIG. 1, and as shown in FIG. 3 by section line 2—2.
Figure 3:
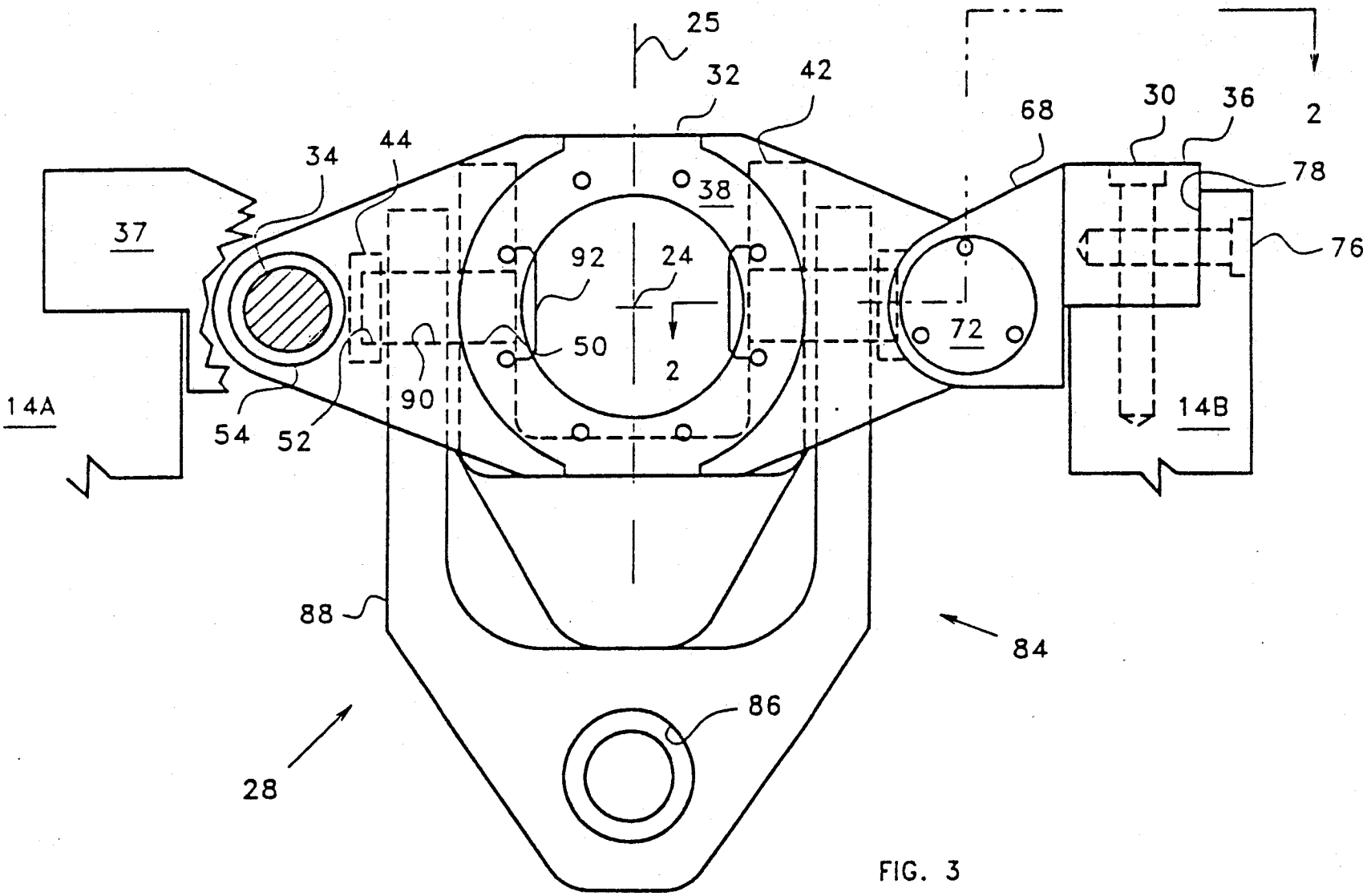
FIG. 3 is an end view of the tool pack subassembly of FIG. 2, taken substantially as shown by view line 3—3 of FIG. 2.

Referring now to FIGS. 2 and 3, the redraw carriage 32 includes spaced-apart front carriage and back carriage plates, 38 and 40, that are parallel to each other and that are orthogonally disposed to the longitudinal axis 24, a U-shaped spacer plate 42, a pair of smaller spacer plates 44, a front bore 46, a rear bore 48, a longer transverse bore 50 that extends through the U-shaped spacer plate 42, and a shorter transverse bore 52 that extends through the smaller spacer plate 44. As shown in FIG. 2, the bores, 46 and 48, are parallel to but spaced apart from the longitudinal axis 24.

A pair of bushings 54 are disposed into respective ones of the bores, 46 and 48, with enlarged portions 56 thereof being proximal to one another, and with a spacer 58 being disposed between the bushings 54 to retain them in respective ones of the bores, 46 and 48.

One of the guide rods 34 is disposed through the bushings 54 with first and second ends, 60 and 62, thereof extending through the bushings 54 and into bores, 64 and 66, of spaced-apart support posts, 68 and 70. The support posts, 68 and 70, are an integral portion of the support frame 36 and extend inwardly from the frame member 14*b* toward the longitudinal axis 24. Caps 72 are attached to respective ones of the support posts, 68 and 70, by cap screws 74.

In operation, the redraw carriage subassembly 28 is moved transversely into position around the longitudinal axis 24 as shown in FIGS. 2 and 3, and is bolted into position by cap screws 30. However, before firmly securing the redraw carriage subassembly 28 with the cap screws 30, homing cap screws 76 are used to home the support frame 36 against a shoulder 78 of the frame member 14*b*, thereby providing precise alignment between the redraw carriage subassembly 28 and the longitudinal axis 24.

Referring again to FIG. 1, the tool pack subassembly 16 includes a redraw die 80 which is disposed around the longitudinal axis 24. In addition, a redraw sleeve 82 is attached to the redraw carriage 32 by any suitable means, not a part of the present invention. As the redraw carriage 32 is moved toward the tool pack subassembly 16, the redraw sleeve 82 both aligns a redraw cup 83 with the longitudinal axis 24 and provides a force against the redraw cup 83 that prevents wrinkling of the redraw cup 83 as it is forced through the redraw die 80.

It should be understood that a plurality of ironing dies are commonly included in the tool pack subassembly 16 together with the redraw die 80. However, for the sake of simplicity, only the redraw die 80 has been illustrated as being a part of the tool pack subassembly 16.

Referring now to FIGS. 2 and 3, the redraw carriage 32 is reciprocated along the longitudinal axis 24 by a yoke 84, and by a rod, not shown, not a part of the present invention, that attaches to a bore 86 of the yoke 84. The yoke 84 further includes clevis portions 88 each having a bore 90 therethrough, and the clevis portions 88 are pivotally attached to the redraw carriage 32 by pins 92 that extend through the bores, 50 and 52, of the redraw carriage 32, as more clearly shown in FIG. 2.

In operation, the redraw carriage 32 is assembled to a pair of support frames, 36 and 37, by a pair of support rods 34 thereby forming a redraw carriage subassembly 28; the redraw carriage subassembly 28 is moved transversely between the tool pack subassembly 16 and the ram carriage 23, both of FIG. 1; the cap screws 30 are inserted through the support frames, 36 and 37, into respective ones of the frame members, 14*a* and 14*b*; the homing cap screws 76 are tightened; and finally the cap screws 30 are tightened to firmly secure the support frames, 36 and 37, to the frame members, 14*a* and 14*b*.

From the preceding description, it can be seen that removal and replacement are accomplished in reverse order, and more particularly that removal and replacement are achieved by movement of the redraw carriage subassembly 28 transversely with respect to the longitudinal axis 24 without removing the tool pack subassembly 16.

For purposes of understanding the claims, it should be noticed that the present invention provides means for removal and replacement of either the redraw carriage subassembly 28 or the tool pack subassembly 16 without affecting the alignment of the other subassembly, 16 or 28.

Further, the present invention provides means for removing the redraw carriage subassembly 28 by movement that is entirely transverse to the longitudinal axis 24. Further, the present invention provides means for: 1) removing the redraw carriage 32 without removing the tool pack subassembly 16; 2) removing the redraw carriage 32 without removing the redraw carriage 32 from the guide rods 34; 3) loosening attachments of the guide rod 34 from the frame member 14*b*; and 4) moving guide rods 34 transversely to the longitudinal axis 24.

The methods of the present invention can be clearly understood by the foregoing description, by the third aspect of the invention, and by the appended claims.

While specific methods and apparatus have been disclosed in the preceding description, it should be understood that these specifics have been given for purposes of disclosing the principles of the present invention and that many variations thereof will become apparent to those who are versed in the art. Therefore, the scope of the present invention is to be determined by the appended claims.

INDUSTRIAL APPLICABILITY

The present invention is applicable to crank and slide presses for manufacturing metal articles, such as beverage containers, having extremely thin drawn and ironed walls.

What is claimed is:

1. Redraw carriage apparatus for use in a can-making machine that includes a frame having a pair of spaced-apart frame members, a redraw die being disposed around a longitudinal axis in a plane intermediate of said frame members, a body maker ram having both a first end proximal to said redraw die and a second end that is attached to a ram carriage distal from said redraw die, a redraw punch being attached to said body maker ram proximal to said first end thereof and being reciprocable along said longitudinal axis with said redraw punch entering into and withdrawing from said redraw die, which redraw carriage apparatus comprises:

a first guide rod being disposed intermediate of said redraw die and said ram carriage, being disposed parallel to said longitudinal axis, and being attached to one of said frame members;

a second guide rod being disposed parallel to said first guide rod and being attached to said frame;

a redraw carriage being disposed around said longitudinal axis, and being slidably mounted to said guide rods;

means, comprising means for forcing one of said guide rods transversely with respect to said one frame member, for aligning said one guide rod with respect to said one frame member; and means, comprising said redraw carriage being slidably mounted to said guide rods, for aligning the other of said guide rods with respect to said one frame member.

2. Redraw carriage apparatus as claimed in claim 1 in which said redraw carriage apparatus includes means, comprising means for loosening said attachment of said first guide rod from said one frame member, for removing said redraw carriage from said can-making machine without removing said redraw die and for removing said redraw carriage without removing said redraw carriage from said guide rods.

3. Redraw carriage apparatus as claimed in claim 1 in which said guide rods each include first and second ends;

said redraw carriage comprises spaced-apart front and back carriage plates;

said slidable mounting of said redraw carriage to said guide rods comprises a first pair of bushings being disposed in said front and back carriage plates, and said guide rods slidably engaging said bushings with both of said ends of said guide rods extending outwardly through respective ones of said bushings;

said attachment of said first guide rod to said one frame member comprises a first support frame having first and second spaced-apart support posts each with a bore that supportingly receives one of said ends of said first guide rod; and said attachment of said second guide rod to said frame comprises a second support frame having first and second spaced-apart support posts each with a bore that supportingly receives one of said ends of said second guide rod.

4. Redraw carriage apparatus for use in a can-making machine that includes a frame having a pair of spaced-apart frame members, a redraw die being disposed around a longitudinal axis in a plane intermediate of said frame members, a body maker ram having both a first end proximal to said redraw die and a second end that is attached to a ram carriage distal from said redraw die, a redraw punch being attached to said body maker ram proximal to said first end thereof and being reciprocable along said longitudinal axis with said redraw punch entering into and withdrawing from said redraw die, which redraw carriage apparatus comprises:

first and second guide rods each having first and second ends, both being disposed parallel to said longitudinal axis, and being spaced apart;

a redraw carriage being disposed around said longitudinal axis, and being slidably mounted to said guide rods;

a first support frame being attached to one of said frame members, and having first and second spaced-apart support posts each with a bore that supportingly receives one of said ends of said first guide rod;

a second support frame being attached to the other of said frame members, and having first and second spaced-apart support posts each with a bore that supportingly receives one of said ends of said second guide rod;

means, comprising means for loosening said attachments of said support frames from said frame members, for removing said redraw carriage without removing said redraw carriage from said guide rods and without removing said redraw die;

means, comprising a pair of homing screws, for aligning said first support frame with respect to said one frame member; and means, comprising said redraw carriage being slidably mounted to said guide rods, for aligning said second support frame with respect to said one frame member.

5. Redraw carriage apparatus as claimed in claim 4 in which said redraw carriage comprises spaced-apart front and back carriage plates; and said slidable mounting of said redraw carriage to said guide rods comprises a first pair of bushings being disposed in said front and back carriage plates, and said guide rods slidably engaging said bushings with both of said ends of said guide rods extending outwardly through respective ones of said bushings.

6. A method for using a metal working crank and slide press that includes a frame having a pair of spaced-apart frame members, a tool pack subassembly comprising a redraw die that is disposed around a longitudinal axis in a plane intermediate of said frame members, a body maker ram having a first end proximal to said redraw die and a second end that is attached to a ram carriage distal from said redraw die and being reciprocable along said longitudinal axis, a redraw punch being attached to said body maker ram proximal to said first end thereof and both entering into and withdrawing from said redraw die, and a redraw carriage subassembly, comprising a redraw carriage, that is disposed intermediate of said tool pack subassembly and said ram carriage, which method comprises:

a) slidably inserting first and second guide rods into said redraw carriage to form said redraw carriage subassembly;

b) attaching said first guide rod to one of said frame members;

c) attaching said second guide rod to said frame;

d) homing said first guide rod with respect to said one frame member; and e) using said redraw carriage to align said second guide rod with respect to said first guide rod.

7. A method as claimed in claim 6 in which:

a) said inserting step and the first said attaching step comprise inserting one end of said first guide rod through an opening in a first support post of a first support frame, sliding said one end of said first guide rod through a bushing in said redraw carriage, sliding said one end of said first guide rod into an opening in a second support post of said first support frame, and attaching said first support frame to said one frame member;

b) the second attaching step comprises using a second support frame with first and second support posts;

c) said step of homing said first guide rod with respect to said one frame member comprises turning homing screws to align said first support frame with respect to said one frame member; and d) said step of using said redraw carriage to align said second guide rod with respect to said first guide rod comprises using said redraw carriage and both of said guide rods to align said second support frame with respect to said one frame member.

* * * * *